US006619080B1

(12) United States Patent
Yu

(10) Patent No.: US 6,619,080 B1
(45) Date of Patent: Sep. 16, 2003

(54) LOCK BOLT STRUCTURE OF STEEL CABLE LOCK

(76) Inventor: Chun Te Yu, No. 41-21, Kuan-Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 0 days.

(21) Appl. No.: 10/119,216

(22) Filed: Apr. 10, 2002

(30) Foreign Application Priority Data

Dec. 31, 2001 (TW) ..... 90224107 U

(51) Int. Cl.[7] ..... E05B 69/00; E05B 73/00
(52) U.S. Cl. ..... 70/58; 70/14; 70/18
(58) Field of Search ..... 70/58, 22–29, 70/424–426, 231, 165, 14, 18

(56) References Cited

U.S. PATENT DOCUMENTS

| | | | | | |
|---|---|---|---|---|---|
| 5,063,760 | A | * | 11/1991 | Horita et al. | 70/23 |
| 5,327,752 | A | * | 7/1994 | Myers et al. | 70/58 |
| 5,381,685 | A | * | 1/1995 | Carl et al. | 70/58 |
| 5,493,878 | A | * | 2/1996 | Murray et al. | 70/58 |
| 5,502,989 | A | * | 4/1996 | Murray, Jr. et al. | 70/58 |
| 5,791,171 | A | * | 8/1998 | Kelley | 70/58 |
| 5,875,657 | A | * | 3/1999 | Kelley | 70/18 |
| 5,983,679 | A | * | 11/1999 | Reyes | 70/58 |
| 6,006,557 | A | * | 12/1999 | Carl et al. | 70/58 |
| 6,058,744 | A | * | 5/2000 | Ling | 70/28 |
| 6,244,080 | B1 | * | 6/2001 | Sakurai | 70/14 |
| 6,257,029 | B1 | * | 7/2001 | Liao | 70/58 |
| 6,305,199 | B1 | * | 10/2001 | Igelmund | 70/58 |
| 6,401,502 | B1 | * | 6/2002 | Yang | 70/30 |
| 6,449,992 | B1 | * | 9/2002 | Yu et al. | 70/58 |
| 6,463,770 | B1 | * | 10/2002 | Lee | 70/58 |

FOREIGN PATENT DOCUMENTS

| | | | |
|---|---|---|---|
| TW | 370147 | * | 9/1999 |
| TW | 413259 | * | 11/2000 |
| TW | 424840 | * | 3/2001 |
| TW | 435561 | * | 5/2001 |
| TW | 435725 | * | 5/2001 |

* cited by examiner

*Primary Examiner*—Lynne H. Browne
*Assistant Examiner*—John B. Walsh
(74) *Attorney, Agent, or Firm*—Troxell Law Office PLLC

(57) ABSTRACT

A lock bolt structure having a center of one end of a casing being formed with an intresting perforation for a shaft to extend through. Multiple axially extending lateral ribs are formed on the circumference of the core shaft, which has a cross-section with a shape corresponding to the intesecting perforation. Two lock bolts having guide channels on opposite faces are disposed on two sides of the intersecting perforation. The outer ends of the bolts are formed with hook sections which extend symmetrically outwards. The lateral ribs are slidably inserted in the guide channels to integrally connect the lock bolts with the core shaft. The cross-shaped cross-section of the core shaft provides enhanced torque strength for the lock bolt structure to avoid damage to the lock by external twisting force.

16 Claims, 5 Drawing Sheets

LOCK BOLT STRUCTURE OF STEEL CABLE LOCK

BACKGROUND OF THE INVENTION

The present invention is related to a lock bolt structure of steel cable lock, and more particularly to a lock bolt structure including two separately movable lock bolts for enhancing torque strength of the lock bolt structure. The lock bolt structure is protected from being damaged by external twisting force so as to achieve a better burglarproof effect.

Taiwanese Patent Publication Nos. 370147, 413259, 424840, 435561 disclose various steel cable locks. The lock bolt structures of such steel cable locks can be substantially divided into two kinds as follows:

First, a fixed lock bolt is disposed on the casing in cooperation with a movable lock bolt. The movable lock bolt can be extended from the fixed lock bolt and engaged in a hole formed on an article to achieve a locking effect (such as Publication Nos. 370147 and 424840). Second, two relatively movable lock plates can be expanded to engage in a hole formed on an article to be locked so as to achieve a locking effect (such as Publication Nos. 413259 and 435561). The above kinds of lock bolt structures are both characterized in that the fixed lock bolt and movable lock bolt (or two movable lock bolts ) are separated from each other. Such lock bolt structures have a certain strength against an external force applied onto the lock bolts to draw the lock bolts out of the hole of the article. However, in the case the lock body is forcedly turned, the lock bolts tend to be twisted, deformed and bent. As a result, the lock bolts can be easily drawn out of the hole of the article.

SUMMARY OF THE INVENTION

It is therefore a primary object of the present invention to provide a lock bolt structure of steel cable lock. Two lock bolts are disposed at one end section of the casing of the lock. The lock bolts can be oppositely pivotally rotated to close or expand. The outer ends of the lock bolts are formed with hook sections which symmetrically outward extends. The lock bolts are formed with guide channels on opposite faces. A core shaft extends between the lock bolts. The circumference of the core shaft is formed with multiple axially extending lateral ribs. Two lateral ribs are slidably inserted in the guide channels of the lock bolts to integrally connect the lock bolts with the core shaft. The core shaft can be extended or retracted by a lock core disposed in the casing so as to contract or expand the lock bolts. The core shaft has a cross-shaped cross-section. The casing is formed with a corresponding cross-shaped perforation. The core shaft is passed through the cross-shaped perforation to provide enhanced torque strength for the lock bolt structure to avoid damage of the lock by external twisting force.

The present invention can be best understood through the following description and accompanying drawings wherein:

DETAILED DESCRIPTION OF THE PREFERRED EMBODIMENT

Figure 1:
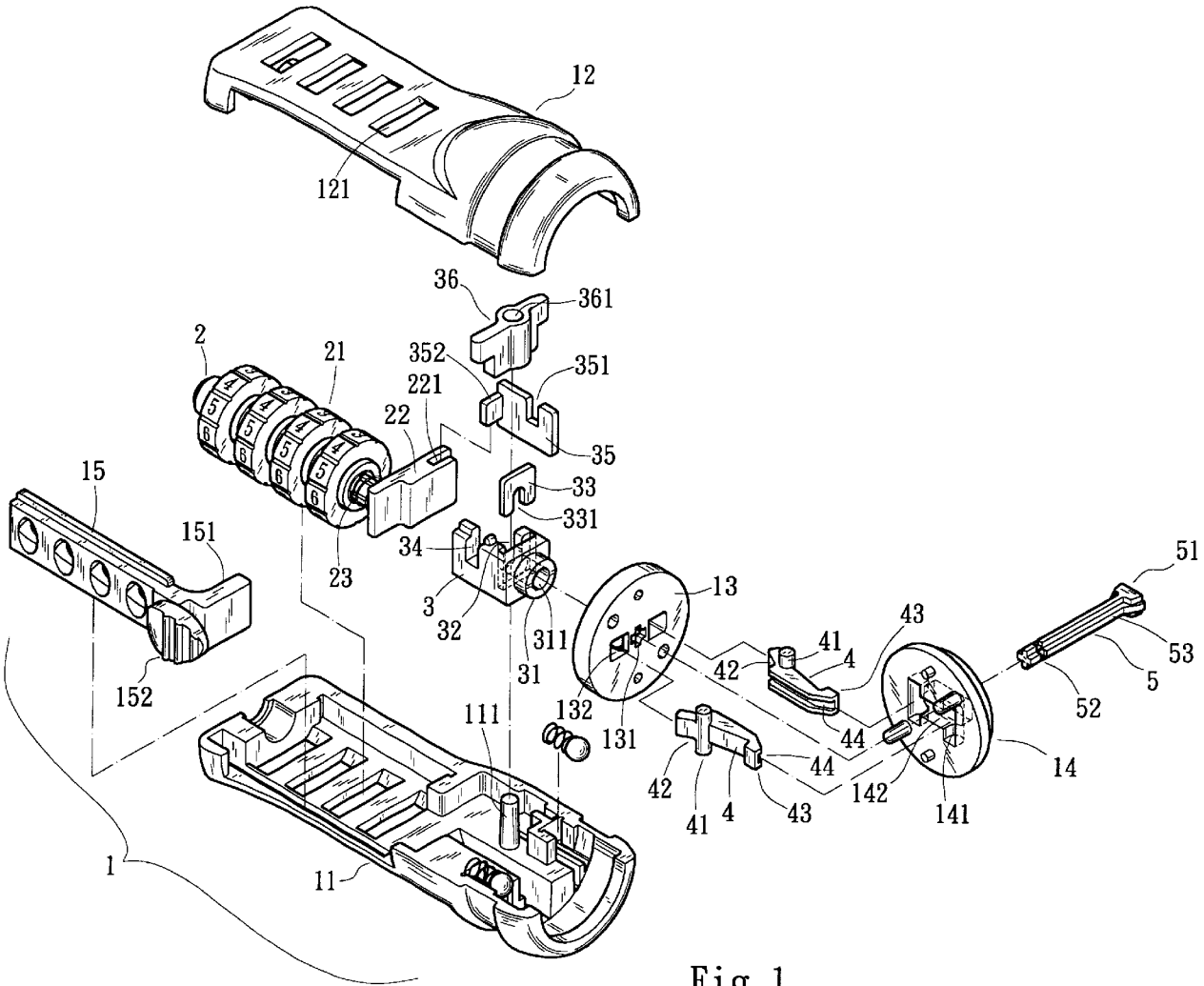
FIG. 1 is a perspective exploded view of the present invention.

Please refer to FIG. 1. The present invention includes a casing 1, a lock core 2, a driving block 3, two lock bolts 4 and a core shaft 5. The casing 1 is composed of a base seat 11 and an upper cover 12. A projecting post 111 is disposed on a middle portion of inner side of the base seat 11. The surface of the upper cover 12 is formed with multiple numeral windows 121. When the base seat 11 and the upper cover 12 are mated with each other, an end section of the base seat 11 and an end section of the upper cover 12 snugly clamp and embrace an inner stop board 13. A shift bar 15 is axially slidably disposed on the circumference of the casing 1. One end of the shift bar 15 has a push section 151 extending into the casing 1. A press block 152 is formed on one side of the push section 151 and outward protrudes from the casing 1. The center of the inner stop board 13 is formed with a substantially cross-shaped perforation 131. Two through holes 132 are formed on two sides of the perforation 131. An inner face of a front cap 14 is connected with outer face of the inner stop board 13. The center of the front cap 14 is formed with a through hole 142. Two parallel slots 141 are formed on the inner face of the front cap 14 on two sides of the through hole 142. Multiple numeral wheels 21 are side by side arranged on the circumference of the lock core 2 for controlling the unlocking/locking operation of the lock core 2. One end section of the lock core 2 is connected with a driving board 22 having a transverse extending insertion channel 221. A restoring spring 23 is disposed between the driving board 22 and the numeral wheels 21 for resiliently restoring the driving board 22. The middle portion of the driving block 3 is formed with an insertion slit 32 and an insertion recess 34 extending in parallel to the insertion slit 32. An engaging board 33 having a notch 331 on bottom side is inserted and located in the insertion slit 32. One end section of the driving block 3 is formed with a boss section 31 having a central through hole 311 communicating with the insertion slit 32. A pivoted plate 36 is pivotally fitted on the projecting post 111 in the base seat 11. One end of the pivoted plate 36 extends into the insertion recess 34. The other end of the pivoted plate 36 extends into an insertion slit 351 of middle portion of a linking board 35. One end of the linking board 35 is formed with a projecting section 352 for inserting into the insertion channel 221 of the driving board 22. A middle portion of each lock bolt 4 is formed with a shaft section 41. One end of the lock bolt 4 is formed with an obliquely extending rear end section 42. The other end of the lock bolt 4 is formed with an outward extending hook section 43. The lock bolt 4 is formed with a longitudinally extending guide channel 44 on one side opposite to the hook section 43. The core shaft 5 is an elongated member. One end of the core shaft 5 is formed with a gradually widened expansion section 51. The other end of the core shaft 5 is formed with an annular groove 52. The circumference of the core shaft 5 is formed with multiple axially extending ribs 53, whereby the core shaft 5 has a cross-section with a shape corresponding to the shape of the cross-shaped perforation 131.

Figure 2:
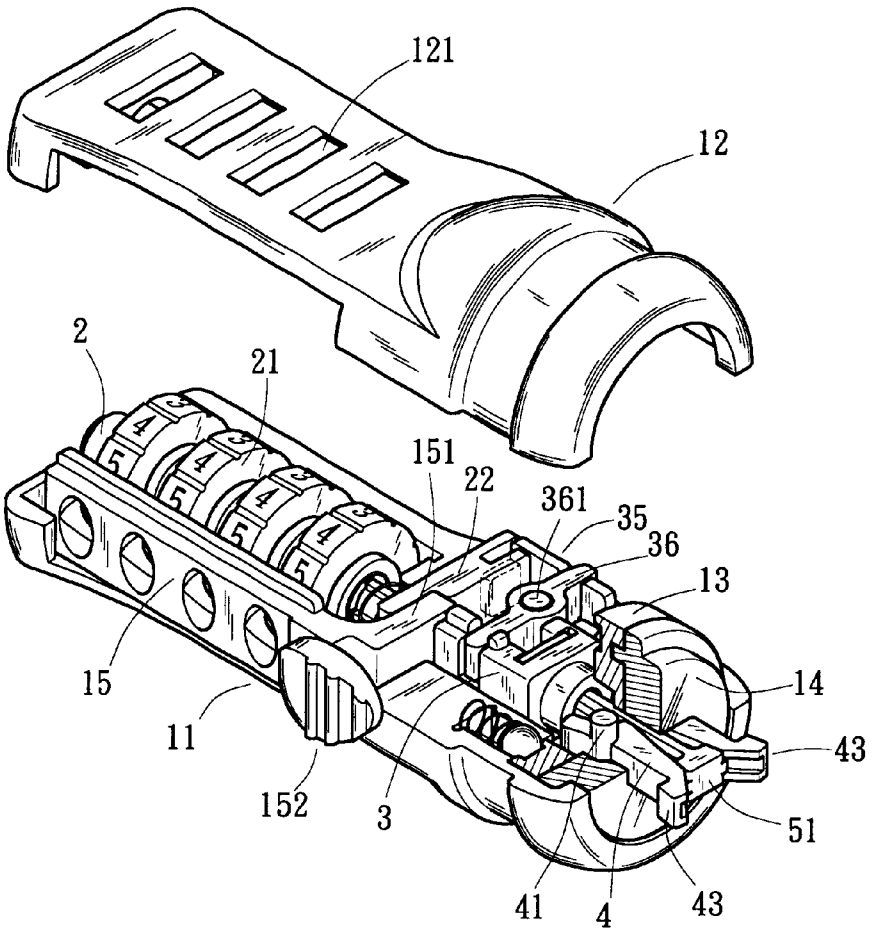
FIG. 2 is a partially assembled view of the present invention.
Figure 3:
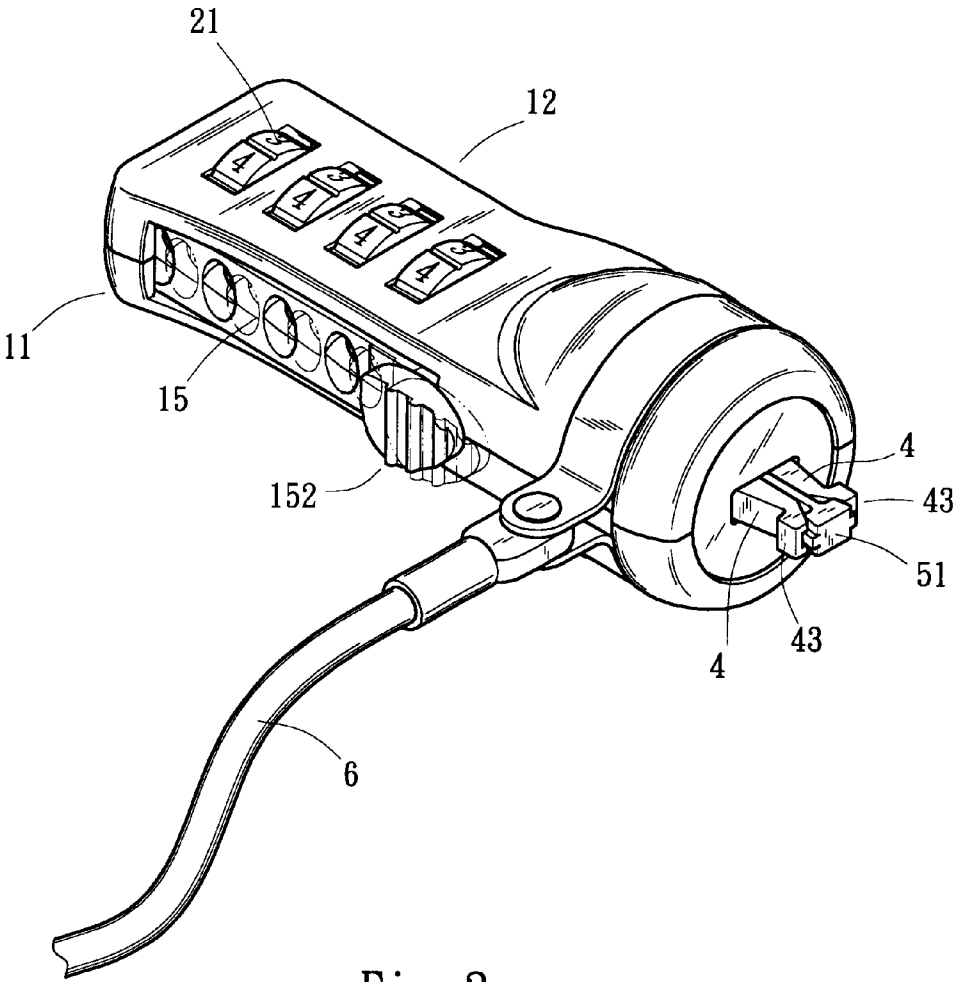
FIG. 3 is a perspective assembled view of the present invention.

Please refer to FIGS. 2 and 3. When assembled, the lock core 2 is received in the casing 1. The numeral wheels 21 are partially exposed to outer side through the numeral windows 121 for a user to shift the numeral wheels 21 for controlling the lock core 2. The push section 151 of the shift bar 15 positioned between the base seat 11 and the upper cover 12 presses outer side of the driving board 22. The driving board 22 is coupled with the linking board 35 via the insertion channel 221 and the projecting section 352. The linking board 35 clamps and fits on one end section of the pivoted plate 36. The other end section of the pivoted plate 36 is drivingly engaged with the driving block 3. With the guide channels 44 opposite to each other, the shaft sections 41 of the two lock bolts 4 are respectively fitted into the slots 141 of the front cap 14. The hook sections 43 pass through the through hole 142 and extend outward. The front cap 14 is connected with the outer face of the inner stop board 13 and the rear end sections 42 of the lock bolts 4 extend into the through holes 132 of the inner stop board 13. The end of the core shaft 5 with the annular groove 52 passes through the cross-shaped perforation 131 of the inner stop board 13 and extends into the through hole 311 of the boss section 31. Via the notch 331, the engaging board 33 inserted in the insertion slit 32 fits into the annular groove 52 to clamp the core shaft 5. Accordingly, the core shaft 5 is drivingly coupled with the driving block 3. When the core shaft 5 is located in its true position, two lateral ribs 53 of the core shaft 5 extend into the guide channels 44 of the lock bolts 4.

After assembled, a steel cable 6 is clamped and connected with the casing 1 to form a complete steel cable lock.

Figure 5:
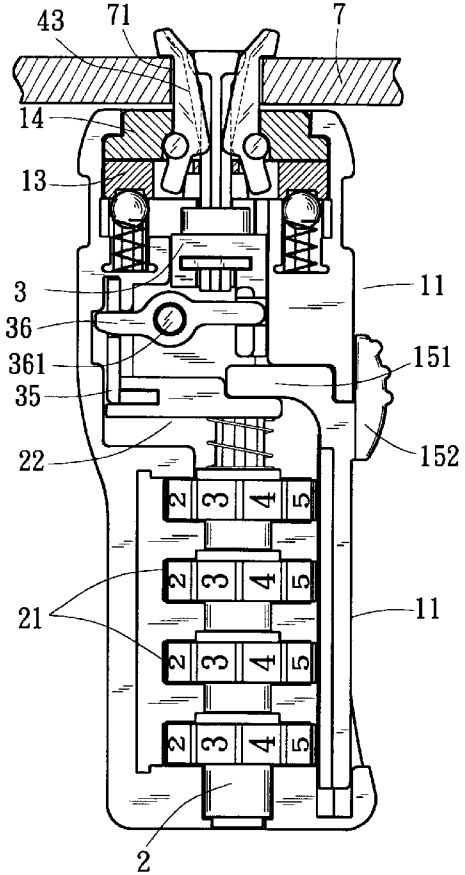
FIG. 5 is a sectional view showing the locking operation of the present invention in another state.
Figure 4:
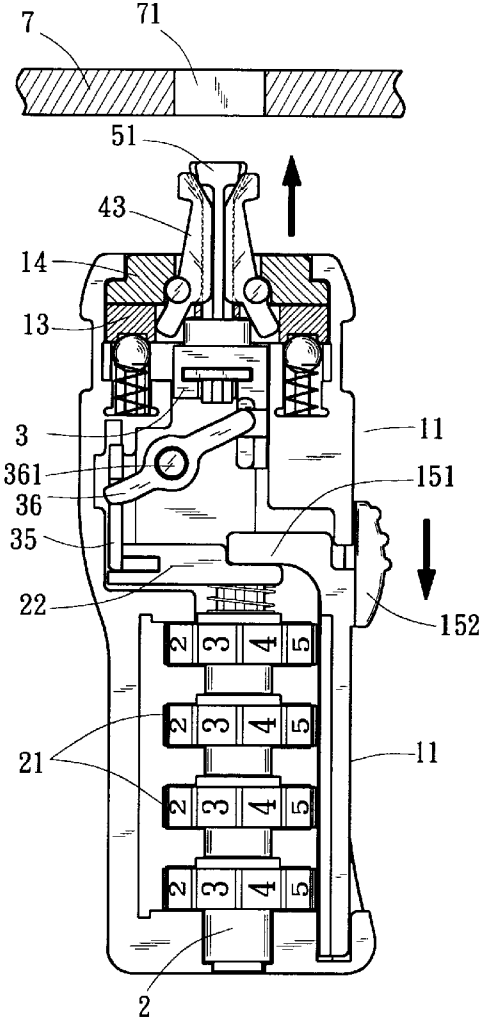
FIG. 4 is a sectional view showing the locking operation of the present invention in one state.
Figure 6:
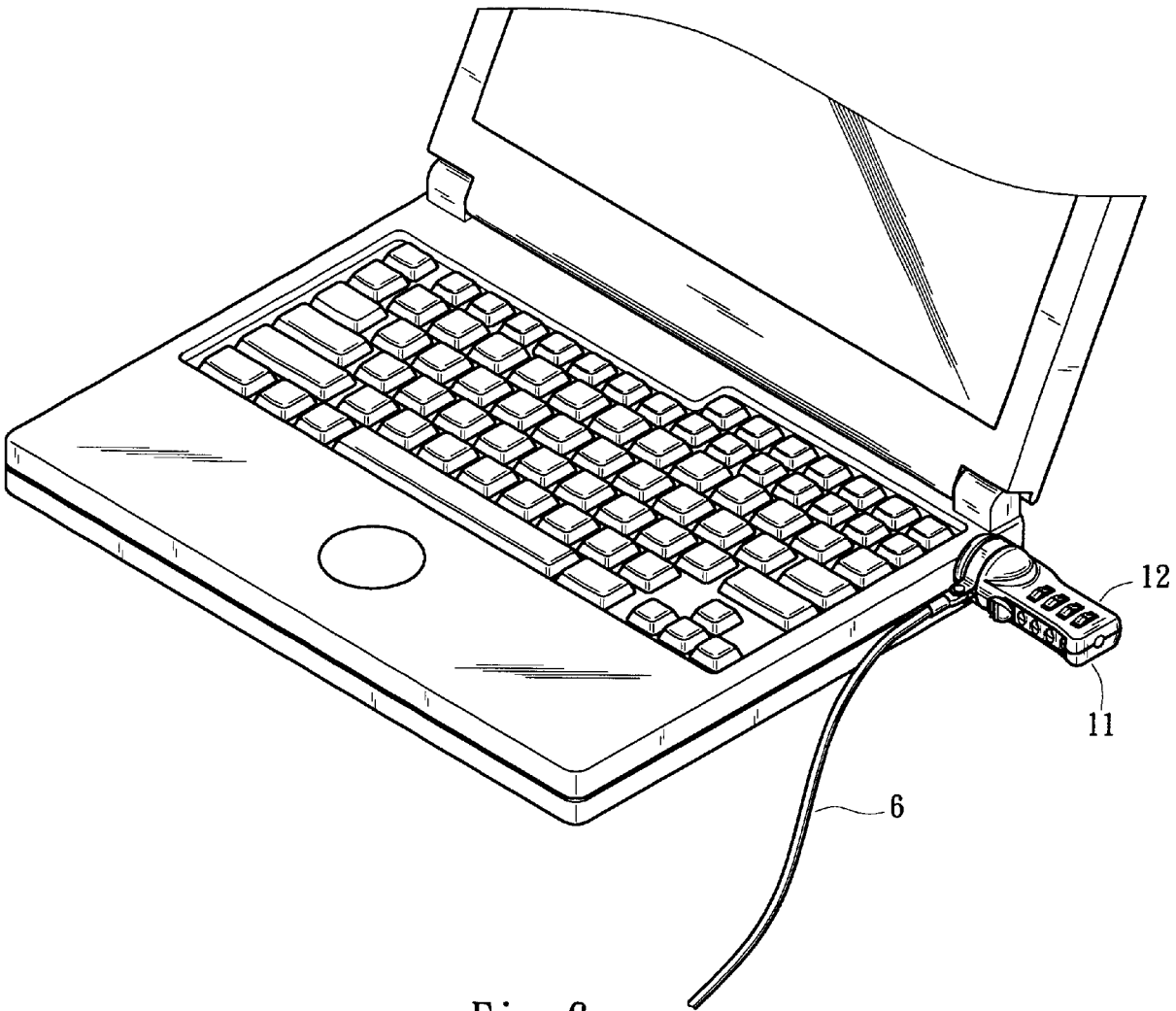
FIG. 6 shows the application of the present invention.

FIGS. 4, 5 and 6 show the operation of the present invention. In use, in the case that a user shifts the respective numeral wheels 21 to correct position, the user can press the press block 152 to push the shift bar 15. At this time, the push section 151 presses and retracts the driving board 22. Via the linking board 35, the driving board 22 pulls one end of the pivoted plate 36, whereby the other end thereof reversely forward pushes the driving block 3. At this time, the boss section 31 of the driving block 3 pushes the lock bolts 4 between the rear end sections 42 thereof. Accordingly, the other ends of the lock bolts 4 are closed toward each other. (At this time, the core shaft 5 is driven by the driving block 3 and the expansion section 51 protrudes outward and the lateral ribs 53 are totally accommodated in the guide channels 44 as shown in FIG. 4.) Under such circumstance, the user can extend the hook sections 43 of the lock bolts 4 into a lock bolt hole 71 formed on the housing 7 of an article to be locked. (FIG. 6 shows a notebook-type computer which is to be locked.) After the hook sections 43 of the lock bolts 4 are inserted and located in the lock bolt hole 71 of the housing 7, the user releases the press block 152 and the restoring spring 23 resiliently restores the driving board 22 to its home position. At this time, the linking board 35 synchronously forward pushes one end of the pivoted plate 36, whereby the other end of the pivoted plate 36 pulls the driving block 3. At this time, the expansion section 51 of the core shaft 5 is synchronously pulled to slide inward between the two lock bolts 4 and abut against the hook sections 43 at outer ends thereof. Under such circumstance, the hook sections 43 are laterally extended to hook inner side of the lock bolt hole 71 of the housing 7 as shown in FIG. 5. Then, the numeral wheels 21 are randomly shifted to form a locked state.

The above operation can be reversely performed to draw the lock bolts 4 out of the lock bolt hole 71 of the housing 7 to unlock the article.

According to the above arrangement, the torque strength of the lock bolts of the steel cable lock is enhanced to avoid damage of the steel cable lock due to external twisting force.

The above embodiment is only used to illustrate the present invention, not intended to limit the scope thereof. Many modifications of the above embodiment can be made without departing from the spirit of the present invention.

What is claimed is:

1. Lock bolt structure of computer steel cable lock, comprising:

a casing receiving therein a lock core and relevant driving members, the center of one end of the casing being formed with an intersecting perforation, outer side of the end being further formed with a through hole, at least one slot being formed beside the through hole, at least one lock bolt passing through the slot, a middle portion of the lock bolt being formed with a shaft section pivotally connected in the casing, an inner end of the lock bolt being formed with an extending rear end section, the rear end section extending into the casing to be driven by the driving members, the other end of the lock bolt being formed with a hook section which extends outward from the casing and laterally oppositely extends, the lock bolt being formed with an axial extending guide channel on an opposite inner face; and a core shaft which is an elongated member, one end of the core shaft being formed with a gradually widened expansion section, the other end of the core shaft being driven by the driving members, at least one axially extending lateral rib being formed on the circumference of the core shaft, whereby the core shaft has a cross-section with a shape corresponding to the shape of the intersecting perforation of the casing, the lateral rib facing the guide channel of the lock bolt being slidably inserted in the guide channel of the lock bolt in a normal state, whereby the end of the core shaft with an annular groove passes through the intersecting perforation of the casing and extends into the casing to be driven by the driving members so as to extend or retract the core shaft, when the core shaft is retracted, the expansion section of the core shaft abutting against and forcing the lock bolt to laterally swing and expand, whereby the hook section at an outer end thereof hooks the inner side of a lock bolt hole formed on a housing of a locked article, in a locked state, the lateral rib of the core shaft keep being slidably inserted in the guide channel of the lock bolt to stably maintain the locked state.

2. Lock bolt structure of the computer steel cable lock as claimed in claim 1, wherein the intersecting perforation of the casing is a substantially cross-shaped perforation and the core shaft has a cross-shaped cross-section corresponding to the cross-shaped perforation of the casing.

3. Lock bolt structure of computer steel cable lock as claimed in claim 1, wherein the lock core in the casing is provided with multiple numeral wheels for controlling a locking/unlocking operation of the lock core.

4. Lock bolt structure of computer steel cable lock as claimed in claim 2, wherein the lock core in the casing is provided with multiple numeral wheels for controlling a locking/unlocking operation of the lock core.

5. Lock bolt structure of computer steel cable lock as claimed in claim 3, wherein the casing is composed of a base seat and an upper cover mated with each other.

6. Lock bolt structure of computer steel cable lock as claimed in claim 4, wherein the casing is composed of a base seat and an upper cover mated with each other.

7. Lock bolt structure of computer steel cable lock as claimed in claim 5, wherein the upper cover is formed with multiple numeral windows, the numeral wheels being exposed to an outer side through the numeral windows for a user to shift the numeral wheels and control the lock core.

8. Lock bolt structure of computer steel cable lock as claimed in claim 6, wherein the upper cover is formed with multiple numeral windows, the numeral wheels being exposed to an outer side through the numeral windows for a user to shift the numeral wheels and control the lock core.

9. Lock bolt structure of computer steel cable lock as claimed in claim 1, wherein the at least one slot comprises two slots parallelly formed on two sides of the through hole, two lock bolts respectively oppositely extending and passing through the slots, the core shaft being inserted between the lock bolts, whereby the core shaft can be extended or retracted to contract or expand the lock bolts.

10. Lock bolt structure of computer steel cable lock as claimed in claim 2, wherein the at least one slot comprises two slots parallelly formed on two sides of the through hole, two lock bolts respectively oppositely extending and passing through the slots, the core shaft being inserted between the lock bolts, whereby the core shaft can be extended or retracted to contract or expand the lock bolts.

11. Lock bolt structure of computer steel cable lock as claimed in claim 1, wherein a front cap is disposed at one end of the casing, the front cap being formed with the through hole and slots for the lock bolts and the core shaft to pass therethrough.

12. Lock bolt structure of computer steel cable lock as claimed in claim 2, wherein a front cap is disposed at one end of the casing, the front cap being formed with the through hole and slots for the lock bolts and the core shaft to pass therethrough.

13. Lock bolt structure of computer steel cable lock as claimed in claim 11, wherein the shaft sections of the lock bolts are directly pivotally connected in the slots.

14. Lock bolt structure of computer steel cable lock as claimed in claim 12, wherein the shaft sections of the lock bolts are directly pivotally connected in the slots.

15. Lock bolt structure of computer steel cable lock as claimed in claim 1, wherein the shaft sections of the lock bolts are directly pivotally connected in the slots.

16. Lock bolt structure of computer steel cable lock as claimed in claim 2, wherein the shaft sections of the lock bolts are directly pivotally connected in the slots.

* * * * *